United States Patent [19]

Massetti

[11] 4,317,463

[45] Mar. 2, 1982

[54] TOOTHBRUSH STRUCTURE

[76] Inventor: Alessandro Massetti, Via Marsala, 47, Milan, Italy

[21] Appl. No.: 56,384

[22] Filed: Jul. 10, 1979

[51] Int. Cl.[3] ..... A45D 44/18

[52] U.S. Cl. ..... 132/84 R

[58] Field of Search ..... 132/84 R; 15/167, 201

[56] References Cited

U.S. PATENT DOCUMENTS

| | | | |
|---|---|---|---|
| 2,206,542 | 7/1940 | Arnold | 15/167 R |
| 2,655,675 | 10/1953 | Grover | 15/167 R |
| 2,662,238 | 12/1953 | Robey | 128/62 A |
| 3,398,421 | 8/1968 | Rashbaum | 15/167 R |
| 3,903,906 | 9/1975 | Collis | 132/84 R |

*Primary Examiner*—G. E. McNeill

*Attorney, Agent, or Firm*—Guido Modiaano; Albert Josif

[57] ABSTRACT

Toothbrush structure comprises a handle with one end whereof a cleaning portion is associated. The cleaning portion includes swab-like elements rotatably carried in the body of the cleaning portion. The cleaning portion includes a plurality of modular elements arranged beside one another, each modular element comprising C-like elements arranged opposite to one another and carrying between the lower and upper legs thereof swab-like elements.

11 Claims, 10 Drawing Figures

TOOTHBRUSH STRUCTURE

BACKGROUND OF THE INVENTION

This invention relates to a toothbrush structure.

As is known, a toothbrush comprises a handle of elongated shape, to one end whereof there are bristles attached.

For years the basic configuration of toothbrushes has remained the same, the only innovations introduced concerning the rounding of the bristle tips, the use of materials other than natural bristles for the brush proper (such as nylon, propylene monofilament, etc.) or of bristles obtained from horsehair, badger's hair, etc., and modifications concerning the shape and cut of the bristles themselves.

While short and long brushing head toothbrushes and toothbrushes with cuspidal or V-like bristles have all been produced, no modifications have been introduced heretofore which could change substantially the configuration of the typical toothbrush, which is yet to prove fully satisfactory for its intended function.

In fact, the traditional toothbrush is only capable of providing a fairly satisfactory brushing action on the front teeth, when moved vertically up and down. As regards the molar and premolar teeth, these cannot be brushed with vertical movements of the toothbrush, but only through horizontal or rotary movements thereof; thus, the toothbrush slides over the teeth, and food residues, and even more so the dental scale, cannot be correctly removed.

Moreover, a most serious drawback of traditional toothbrushes is that, owing to their configuration, they do not lend themselves to the brushing of the teeth inside, only a very limited area being reachable there and this at the expense of unnatural movements by the user.

Consequently, food residues can neither be fully removed from the outside of the molar and premolar teeth, nor removed from the tooth inside at all, the same being also true for scale.

SUMMARY OF THE INVENTION

This invention sets out to eliminate such prior drawbacks by providing a toothbrush which affords the possibility of completely cleaning one's teeth both on the outside and inside, to completely remove any food residue from between the teeth as well as any scale present, without obliging the user to perform unnatural or difficult movements.

within that general aim, it is possible to arrange that the toothbrush of this invention, while departing in a substantial way from a conventional toothbrush, is of extremely simplified construction and such that, if desired, it can be made up of modular elements.

It is further possible to arrange that the toothbrush of this invention is readily adaptable to individual user's requirements, inasmuch as it adjusts itself to different conformations of the oral cavity and dental crown.

It is further possible to arrange that the toothbrush of this invention can be easily made from materials which are currently available on the market, and is highly also competitive in cost.

According to one aspect of this invention, there is provided a toothbrush comprising a handle with one end whereof a cleaning portion is associated, characterized in that said cleaning portion includes swab-like elements rotatably carried in the body of said cleaning portion.

BRIEF DESCRIPTION OF THE DRAWINGS

Further features and advantages will be more clearly apparent from the following description of some preferred, though not limitative, embodiments of this toothbrush struture, illustrated by way of example only in the accompanying drawings, where.

DESCRIPTION OF THE PREFERRED EMBODIMENTS

Figure 2:
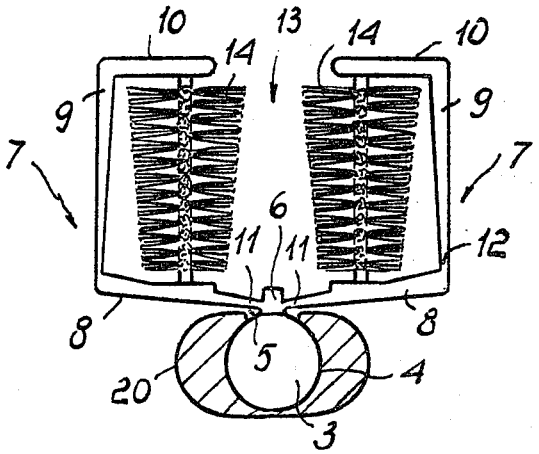
FIG. 2 is a sectional view taken along the line II—II of FIG. 1.
Figure 3:
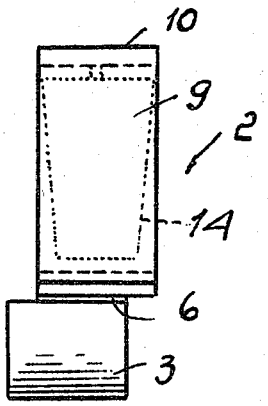
FIG. 3 is a side elevational view of a modular element comprised in the toothbrush of FIG. 1.
Figure 4:
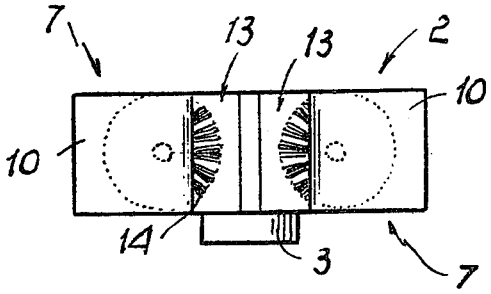
FIG. 4 is a top plan view of the modular element.
Figure 1:
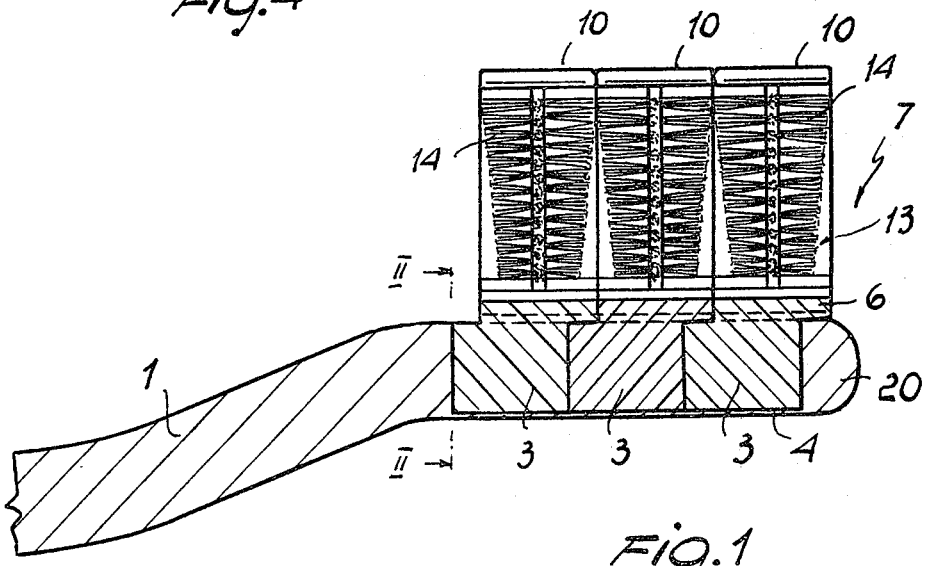
FIG. 1 shows a first embodiment of the toothbrush, in longitudinal section.

With reference to FIGS. 1 to 4, the toothbrush structure according to this invention comprises a handle, generally indicated at 1, which may be of any shape and design and will not be described in detail. With one end of said handle 1, there is associated the cleaning portion of the toothbrush, which comprises modular elements 2 arranged one beside another.

Each modular element 2 includes a cylindrical base body 3 which can be inserted into a cylindrical seat 4 defined in said handle 1 and has an axis which extends parallel to the longitudinal extension of the handle 1. Said seat 4 is provided with a groove 5 at the top, which also extends in a longitudinal direction, and the function whereof will be explained hereinafter.

The cylindrical base body 3 is so inserted into the seat 4 as to have its axis arranged concentrically to the axis of the seat 4; furthermore, from the side surface of the body 3, there extends a connection tailpiece 6 having a smaller width than the groove 5, from which tailpiece there extends a pair of C-like elements 7 arranged opposite to each other. More specifically, each C-like element has a lower leg 8 which is connected with its free end to the cited connection tailpiece 6 and with its other end to a central portion 9, laying substantially perpendicular to the lower leg 8, which is in turn connected at the top to an upper leg 10 laying substantially parallel to the leg 8.

Moreover, it should be noted that at the connection region between the lower leg 8 and connection tailpiece 6, there is provided a weakened area 11 the function whereof will be explained herein below; a thinned area 12 is further provided at the connection region between the central portion 9 and lower leg 8.

Between the lower legs 8 and upper legs 10 of each C-like element 7, there is carried rotatably a swab, generally indicated at 13, which has a rotation axis substantially perpendicular to the longitudinal extension of the toothbrush and approximately parallel to the central portion 9.

Each swab element 13 has bristles 14 having their free ends arranged, of preference, in the shape of a truncated cone having its major base facing the upper leg 10; moreover, at the major base, the bristles 14 are so dimensioned as to project sideways with respect to the C-like elements, thereby they interfere at least in part with the bristles of a swab element 13 located adjacently thereto such as to transmit to it a counter-rotation movement.

With the structure described above, each C-like element 7 is enabled to oscillate, independently of an adjacent C-like element, with respect to the axis of the seat 4, and this oscillation, although limited, is permitted by the connection tailpiece 6 having, as mentioned in the foregoing, a smaller width than the groove 5.

Furthermore, the C-like elements 7 are axially offset with respect to the cylindrical base body 3, such that it becomes possible to close the free end of the seat 4 with a plug member, indicated schematically at 20, which does not project eccessively with respect to the last of the C-like elements 7.

It should be pointed out, moreover, that the number of the C-like elements 7 may be any one, to suit individual requirements, although tests carried out indicate as suitable the use of two or three C-like elements 7.

The utilization of the toothbrush according to the embodiment just described is quite simple. In fact, it will be used by arranging the C-like elements 7 practically astride the dental crown, such that one swab element 13 can act on the inside, whereas the opposite swab element 13 will act on the outside of the dental crown.

After the toothbrush has been so positioned, it will be sufficient to push the toothbrush towards the mouth rear and then pull with a horizontal back-and-forth movement to produce friction between the swabs and the teeth. The swab elements 13 thus rotate about their pivot pin, which will be obviously made of a rustproof material or a material impervious to other contaminants, thereby the bristles penetrate between the teeth to completely remove every food residue both from the tooth outside and inside, as well as the dental scale.

Moreover, by providing the base body 3, each C-like element 7 is allowed a certain oscillation with respect to the handle 1 of the toothbrush, such that each modular element can take the most appropriate position both in regards to the tooth thickness and, as is frequently the case, to an irregular dental crown (i.e. teeth which project inwardly or outwardly from the dental crown).

Furthermore, by providing the weakened area 11 and thinned area 12, elastic points are practically created which permit the axis of the swabs to vary independently such that each swab element 13 is at all times caused to adhere in an ideal manner to the teeth whereon they are working.

Moreover, it should be added to the foregoing that by suitably varying the inclination of the toothbrush, it becomes possible to effectively clean the chewing portions of the teeth as well as to massage the gums.

Figure 7:
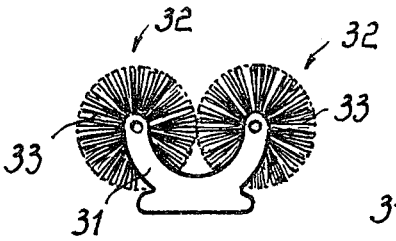
FIG. 7 is an end view of the toothbrush of FIG. 5.
Figure 6:
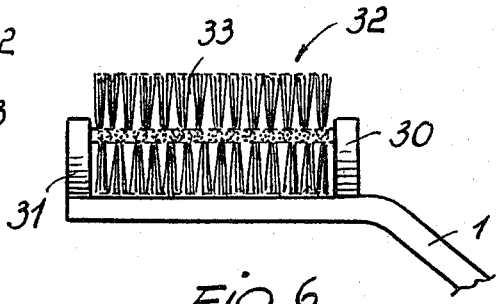
FIG. 6 is a side elevational view of the toothbrush of FIG. 5.
Figure 5:
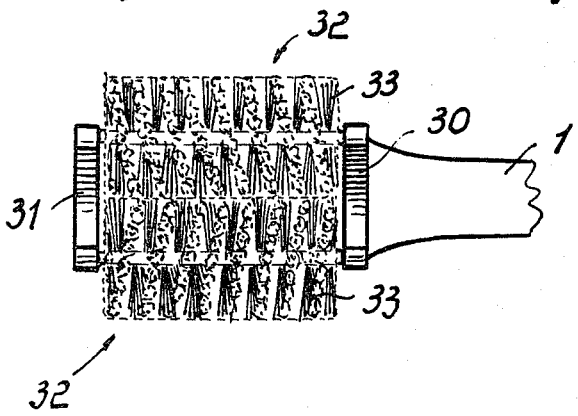
FIG. 5 is a plan view of a second embodiment of the toothbrush.

Making now reference to FIGS. 5 to 7, another embodiment of the toothbrush is illustrated which relates in principle to the one just described.

According to this embodiment, the toothbrush still has a handle 1, which will not be further discussed because it can have any shape and design, at one end of said handle 1 there being provided a pair of U-like elements 30 and 31, arranged oppositely spaced apart from each other. At the free ends of their legs said U-like elements 30 and 31 carry a pair of longitudinal swab elements 32 which extend parallel to each other and substantially parallel to the longitudinal direction of the toothbrush.

The bristles 33 provided on the longitudinal swab elements 32 have a substantially cylindrical peripheral configuration and are so arranged that the bristles of the two swabs 32 adjacent to each other interfere at least partially with one another. Moreover, the bristles 33 are so arranged as to have a cylindrical helix arrangement which facilitates, as the toothbrush is being used, the rotation of the swabs 32 about their axis.

The toothbrush of this embodiment is used similarly to the previous one. In fact, it will be sufficient that the toothbrush be applied so that the two swabs 32 be located respectively on the inside and outside of the dental crown, whereafter a reciprocating movement in a horizontal direction is effected to simultaneously clean the inside and outside of the dental crown; moreover, the arrangement of the bristles 33 along a cylindrical helix causes the reciprocating translatory movment to produce a rotary component which induces the swabs to slightly rotate about their axis, thus increasing their cleaning effectiveness.

It should be added that by holding the toothbrush inclined, the swabs 32 can be arranged in such a way that one of them is active on the chewing surface, while the other acts on the outer or inner surfaces of the teeth, thus providing a combined cleaning action for both areas.

In all of the instances just discussed, it is significantly important that the swabs be rotated about their axis, to thus increase considerably the effectiveness of the cleaning action.

Figure 10:
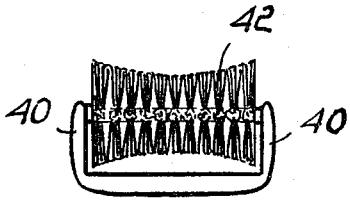
FIG. 10 is an end view of the toothbrush of FIG. 8.
Figure 9:
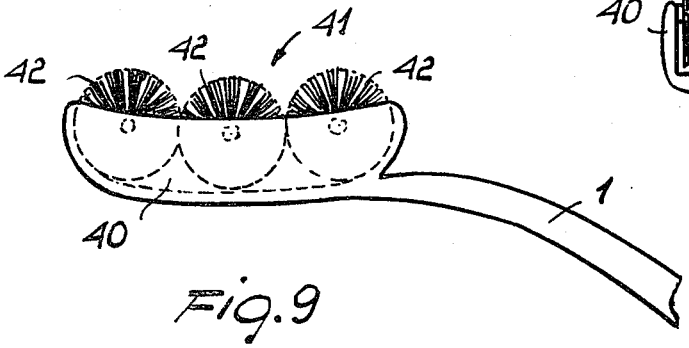
FIG. 9 is a side elevational view of the toothbrush of FIG. 8.
Figure 8:
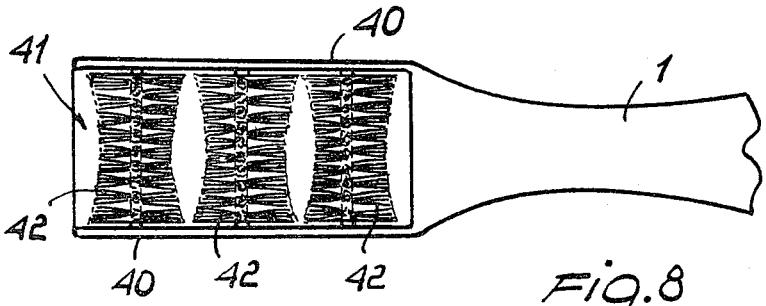
FIG. 8 is a plan view of a third embodiment of the toothbrush.

With reference to FIGS. 8 to 10, a third embodiment of this toothbrush will be described which relates in principle to the ones previously discussed, wherein at one end of a handle 1, again of any desired configuration, there is provided a pair of longitudinal side members 40 arranged opposite to each other. The side members 40 carry a plurality of transverse swabs 41 which have their rotation axis perpendicular to the side members 40 and to the longitudinal direction of the toothbrush.

Advantageously, the configuration of the set of bristles 42 is such that the bristles 42 have a substantially cylindrical configuration which tapers centrally and is in a way comparable to a rotational hyperboloid.

In this case also, the number of swabs 41 may be anyone, according to individual requirements and needs.

This embodiment of the invention is utilized by placing the working portion of the swabs 41 above the chewing portion of the dental crown or arch. By virtue of the special configuration of the swabs 41, the bristles 42, additionally to being active on the chewing portion, will also be active on the inner and outer portions of the dental crown or arch.

The horizontal reciprocating movement of the toothbrush will cause at least one swab 41 to rotate, thereby its bristles will execute an effective cleaning action.

It will be apparent from the foregoing that the invention achieves its objects, and in particular it is stressed that by providing swab elements which are rotatably carried by the toothbrush handle, in addition to radically modifying the traditional concept of a toothbrush, a more effective cleaning action is achieved, with obvious attendant advantages relative to the hygiene of the oral cavity.

Obviously, the material from which the handle is formed, and the material from which the bristles are formed, may be anyones and vary within a wide range, with the condition, of course, that non-toxic materials be employed.

The invention as described is susceptible to several modifications and variations all of which fall within the scope of this inventive concept.

Furthermore, all the details may be replaced with other technically equivalent elements.

In practicing the invention, the materials used, as well as the dimensions and shapes may be any ones to suit individual applicational requirements:

I claim:

1. A toothbrush structure comprising a handle with one end whereof a cleaning portion is associated, including swab-like elements offset with respect to each other and rotatably carried in the body of said cleaning portion, wherein according to the improvement each swab-like element has bristles projecting sidewise thereby to interfer at least in part with the bristles of an adjacent swab-like element to transmit to it a counter-rotation movement.

2. A toothbrush structure according to claim 1, characterized in that said cleaning portion includes a plurality of modular elements arranged beside one another, each modular element comprising C-like elements arranged opposite to one another and carrying between the lower and upper legs thereof swab-like elements having the axis of rotation thereof substantially perpendicular to the longitudinal direction of said toothbrush and substantially parallel to the central portion joining together said lower and upper legs.

3. A toothbrush structure according to claim 1, characterized in that said swab elements have bristles with a substantially truncated cone configuration having the major base thereof facing said upper leg.

4. A toothbrush structure according to claim 1, characterized in that said cleaning portion comprises a pair of longitudinal swab-like elements rotatably carried in a pair of U-like element located opposite to each other and spaced apart, said U-like element being provided at the end of said handle, said longitudinal swab-like elements having the rotation axis thereof substantially parallel to the longitudinal direction of said handle.

5. A toothbrush structure according to claim 1, characterized in that said cleaning portion comprises a plurality of transverse swabs carried rotatably in a pair of longitudinal side members provided at the end of said handle, said transverse swabs having the rotation axis thereof substantially perpendicular to said longitudinal side members and to the longitudinal direction of said toothbrush.

6. A toothbrush structure according to claim 2, characterized in that said modular elements have a cylindrical base body wherefrom said C-like elements extend, said cylindrical base body being accommodated inside a cylindrical seat defined in the handle and having at the top a longitudinal groove wherein there is accommodated for oscillation a connection tailpiece extending from the side surface of said base body and associated with the free end of said lower leg of said C-like elements.

7. A toothbrush structure according to claim 6, characterized in that it comprises a weakened region at the connection area between the free end of said lower leg and said connection tailpiece.

8. A toothbrush structure according to claim 4, characterized in that it comprises a thinned region at the connection area between said central portion and said lower leg.

9. A toothbrush structure according to claim 6, characterized in that said C-like elements and said base body are interconnected in an axially offset relationship to each other.

10. A toothbrush structure according to claim 4, characterized in that said longitudinal swab-like elements have bristles arranged in a substantially cylindrical shape and along a cylindrical helix.

11. A toothbrush structure according to claim 5, characterized in that the bristles of said transverse swabs are arranged in a substantially cylindrical shape, said substantially cylindrical shape being tapered centrally.

* * * * *